United States Patent [19]

Rosenthal

[11] Patent Number: 5,044,800

[45] Date of Patent: Sep. 3, 1991

[54] DEVICE FOR DETACHABLY SUPPORTING A DRUM IN LATERAL WALLS OF A HOUSING

[75] Inventor: Manfred Rosenthal, Kirchen-Freusburgh, Fed. Rep. of Germany

[73] Assignee: U.S. Philips Corporation, New York, N.Y.

[21] Appl. No.: 537,559

[22] Filed: Jun. 13, 1990

[30] Foreign Application Priority Data

Jun. 16, 1989 [DE] Fed. Rep. of Germany ..... 3919754

[51] Int. Cl.[5] ..... B41J 11/02

[52] U.S. Cl. ..... 400/660; 384/439; 400/660.2

[58] Field of Search ..... 400/649, 659, 660, 660.1, 400/660.2, 692, 637.1, 636.1; 384/439, 440, 441, 443, 256, 262

[56] References Cited

U.S. PATENT DOCUMENTS

| | | | |
|---|---|---|---|
| 1,523,480 | 1/1925 | Grandjean | 400/660.2 |
| 2,542,868 | 2/1951 | Hart et al. | 400/660.2 |
| 2,880,839 | 4/1959 | Messner et al. | 400/660.2 |
| 4,802,795 | 2/1989 | Takada . | |

FOREIGN PATENT DOCUMENTS

| | | | |
|---|---|---|---|
| 322750 | 7/1919 | Fed. Rep. of Germany | 400/660 |
| 606986 | 8/1960 | Italy | 400/660 |
| 0149381 | 7/1986 | Japan | 400/660 |
| 0174171 | 7/1987 | Japan | 400/660 |
| 48664 | 1/1919 | Sweden | 400/660.2 |
| 2062126 | 5/1981 | United Kingdom | 400/660 |

OTHER PUBLICATIONS

"Easy Remove Patent" IBM Technical Disclosure Bulletin, vol. 21, No. 9, 2/79, pp. 3696-3697.

"Molded Platen Shaft Bearing Assembly for Office Printers and Typewriters", IBM Tech. Discl. Bulletin, vol. 25, No. 71, 12/82, pp. 3863-3864.

"Automated Assembly Clip" IBM Technical Disclosure Bulletin vol. 27, No. 12, 5/85, pp. 6820-6821.

"Securing Element for Axles and Shafts" IBM Technical Disclosure Bulletin, vol. 27, No. 12, 5/85, p. 7063.

*Primary Examiner*—Eugene H. Eickholt

*Attorney, Agent, or Firm*—William Squire

[57] ABSTRACT

A device for supporting a printer drum in lateral walls of a housing includes a detachable bearing bushing mounted on one end journal of the drum. That one end journal of the drum is journalled in a closed bearing opening and the other end journal of the drum is arranged via the bearing bushing in a transversely open bearing of a supporting wall which is connected to one of the lateral walls, the bearing bushing can be locked to the supporting wall after rotation of the bearing bushing through a flexible and detent lockable lever connected to the bushing. The bearing bushing is assembled and disassembled by sequential longitudinal and transverse displacements relative to the open bearing, A guide trough aligns the drum journal with the closed bearing during assembly of the drum.

16 Claims, 5 Drawing Sheets

DEVICE FOR DETACHABLY SUPPORTING A DRUM IN LATERAL WALLS OF A HOUSING

The invention relates to a device for detachably supporting a drum in lateral walls of a housing whilst inserting a bearing bushing which is mounted on a journal of the drum into an open bearing recess in one of said lateral walls, said bearing bush being provided with a lockable flexible lever.

A device of the kind mentioned above is known, for example from German Patent 3210024. In the known construction, a device is concerned for detachably securing rod systems in lateral walls, which have bearing recesses open on one side. At both ends of the rod systems bearing bushing are provided, which are flattened at least on one side in accordance with a reduced recess width of the bearing recess. For mounting, the rod system is inserted with the flattened sides of the bearing bushing into the bearing recessed, rotated and snap-locked through a snapping connection between the flexible levers and the walls. The rod system can be taken again from the walls in inverse manner.

In printers with a flat paper transport, the paper track with the associated guide and transport elements is arranged in the lowermost part of the apparatus. In such a construction, the platen for the printing head, i.e. the drum, is arranged in the lowermost part of the printer between the lateral housing walls. These walls support not only the drum, but also all the other necessary guide and transport elements for movement of the paper and movement of the printing head. In such a construction comprising a drum journalled in the lowermost part, problems arise when exchanging the drum. In general, the cover of the printer should not be removed so that a solution in which the drum is passed laterally through a sidewall is excluded. A further possibility is an exchange in upward direction. However, it should then be taken into account that the printing head with its paper guide is located above the drum.

Therefore, the invention has for its object to construct the drum and its support in such a manner that the exchange can take place without the use of a tool and without removing an apparatus cover. In a device of the kind mentioned in the opening paragraph, this object is achieved in that the open bearing recess in which is supported said one journal of the drum is arranged in a supporting wall between said one journal of the drum is arranged in a supporting wall between the lateral walls which is connected to the one of said lateral walls. Thus, it is possible to incorporate the drum from above in that it is first introduced into the housing with the end to be inserted into a closed bearing opening; the drum is then inserted with its other end through a pivot movement about the printing head brought to a righthand position into the open bearing recess, which is provided in the supporting wall. Subsequently the drum can be inserted with its one end into the closed bearing opening and then be locked to the supporting wall at its other end by rotation of the bearing bushing through the flexible lever connected to the bushing. The drum is disassembled in inverse order of succession, that is to say that first the locking at the end with the open bearing recess is released, after which the drum is moved by a longitudinal movement out of the closed bearing opening, whereupon it is removed from the housing with a pivot movement about the printing head. This possibility of assembling and disassembling the drum by means of a pivot movement is obtained in that on the one hand a closed bearing opening is provided and on the other hand an inwardly protruding open bearing recess is provided. This protruding bearing point permits of readily assembling and disassembling and also of readily locking and unlocking the drum at this point.

In an embodiment of the invention the supporting wall is a part of the one of said lateral walls which is formed by cutting and bending. Thus, a separate supporting wall with specific securing means becomes superfluous.

In a further embodiment of the invention, the bearing bushing has a first section with a diameter adapted to a first part of the bearing recess and a second section with a diameter adapted to a second entrance part of the bearing recess which is narrow with respect to the first pawt, the lever being arranged in a boundary region between the two sections and having a neck fitting into the narrow second entrance part. This construction affords the advantage that the drum can first be inserted transversely with the section of smaller diameter of the bearing bushing into the open bearing recess. Subsequently, the drum can be displaced longitudinally over such a distance that the other end engages into the closed bearing opening, the neck of the flexible lever passing through the narrowed entrance part of the open bearing recess and the bearing bushing now being located with its first section in the adapted bearing recess. Subsequently, the bearing bushing can be rotated over such a distance that its flexible lever can be locked. The bearing bushing mounted on the drum journal is therefore held immovably in the open bearing recess. As a result, the mounting of the drum is facilitated.

In the drawing, FIGS. 1 to 8 show an embodiment of the device according to the invention.

Figure 8A:
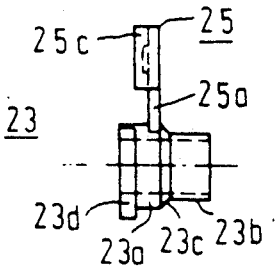
Figure 8B:
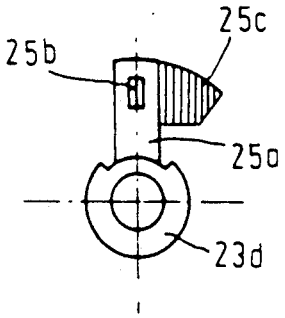

FIGS. 8*a* and 8*b* show in two elevation a bearing bushing used in accordance with the invention.

Figure 1:
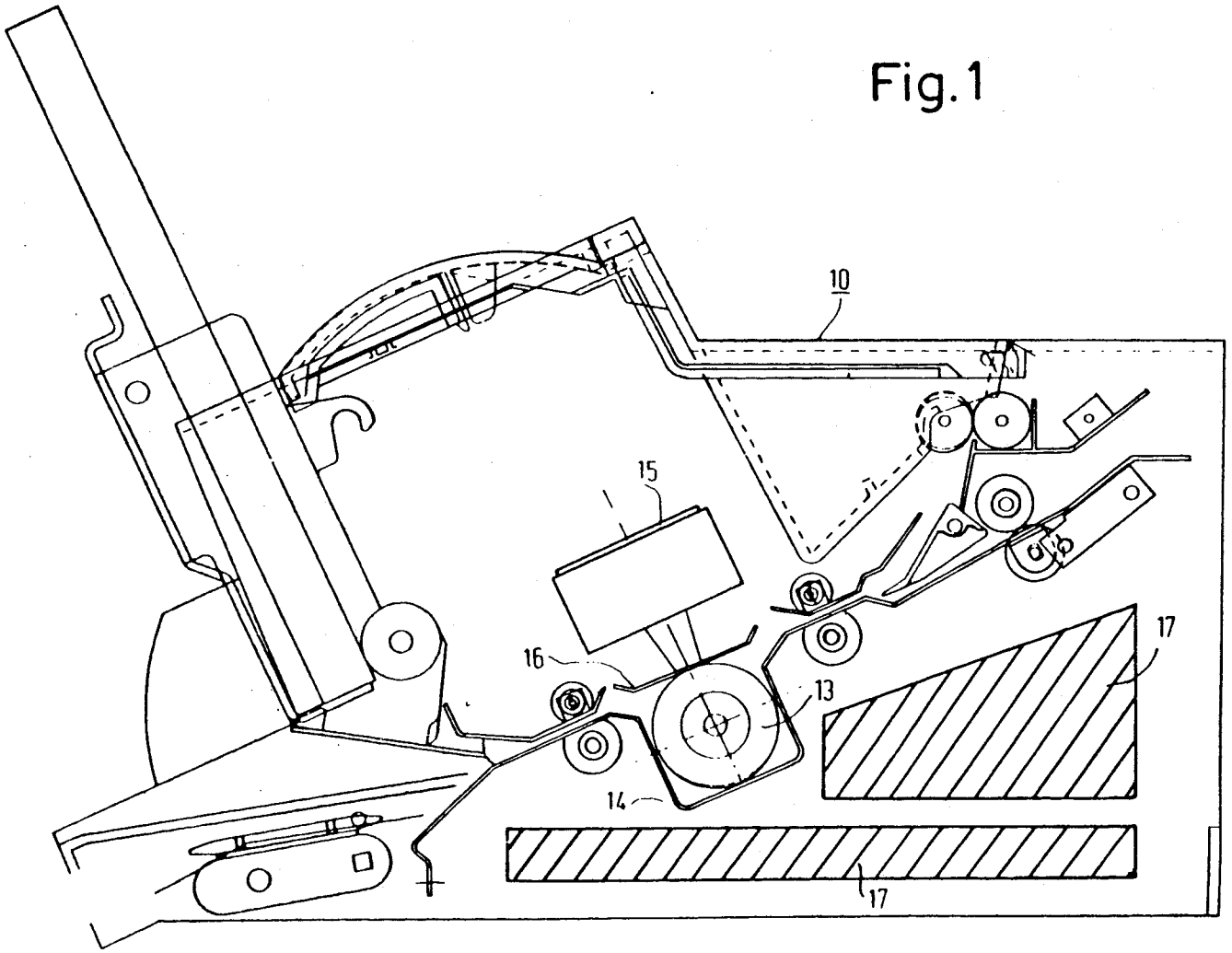
FIG. 1 shows in a diagrammatic side elevation a printer having a drum arranged in the lower part.
Figure 4:
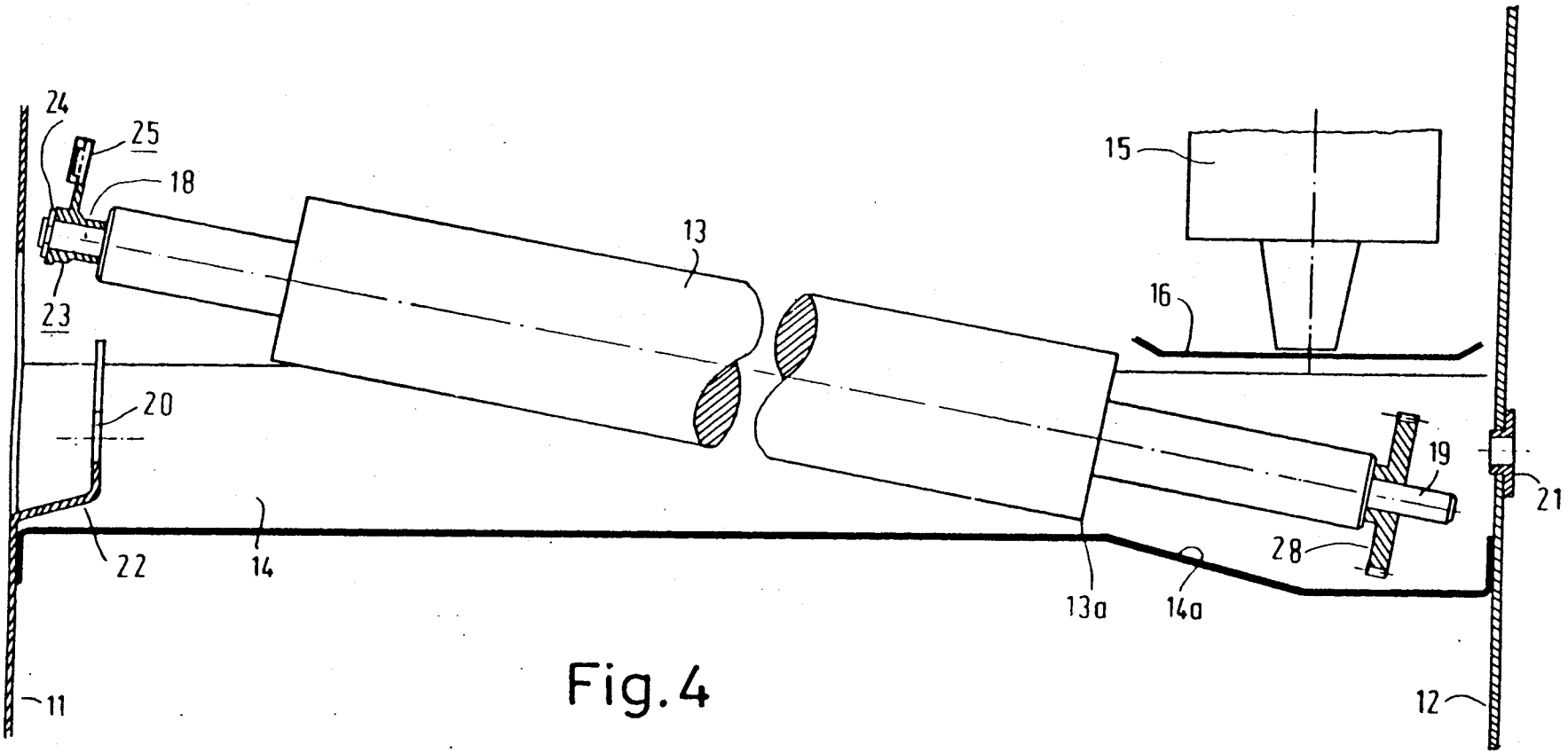

The printer shown in FIG. 1 comprises a housing 10 having lateral walls 11, 12, in which a drum 13 is journalled. Reference numeral 14 designates a trough, which is arranged around the drum and serves for guiding the drum during assembling and disassembling. Reference numeral 15 designates a printing head movable along the drum 13 and having a paper guide shield 16 and reference numeral 17 denotes electronic components. The drum 13 has two journals 18, 19 for journalling respectively in an open bearing recess 20 and in a closed bearing opening 21 (FIG. 4). The open bearing recess 20 is located in a supporting wall 22 cut out of the wall 11 and bent inwards. Reference numeral 23 denotes a bearing bushing mounted by means of a clamping ring 24 on the journal 18 (see also FIG. 8).

Figure 2:
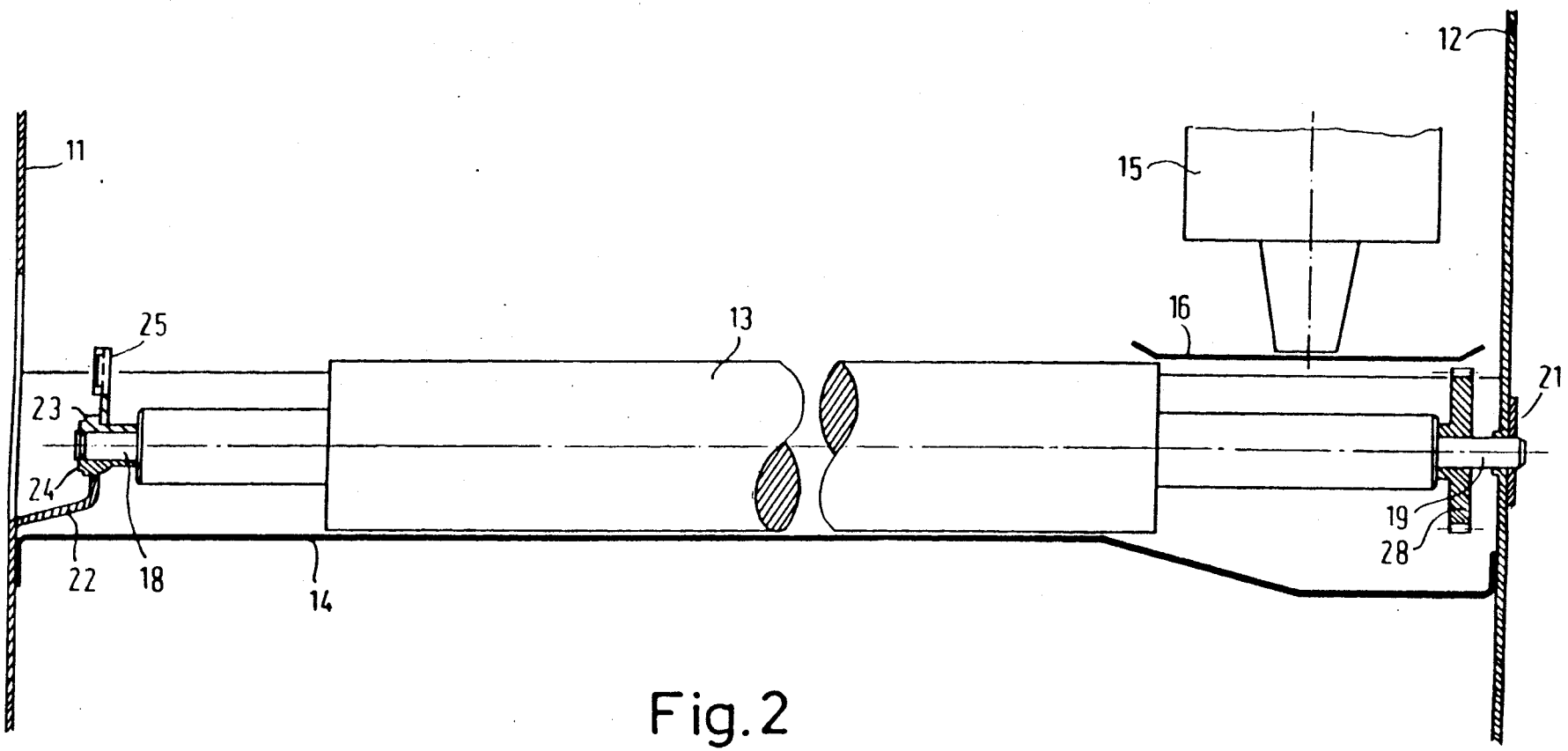
FIGS. 2 to 4 show three different mounting positions of the drum in a front elevation.
Figure 3:
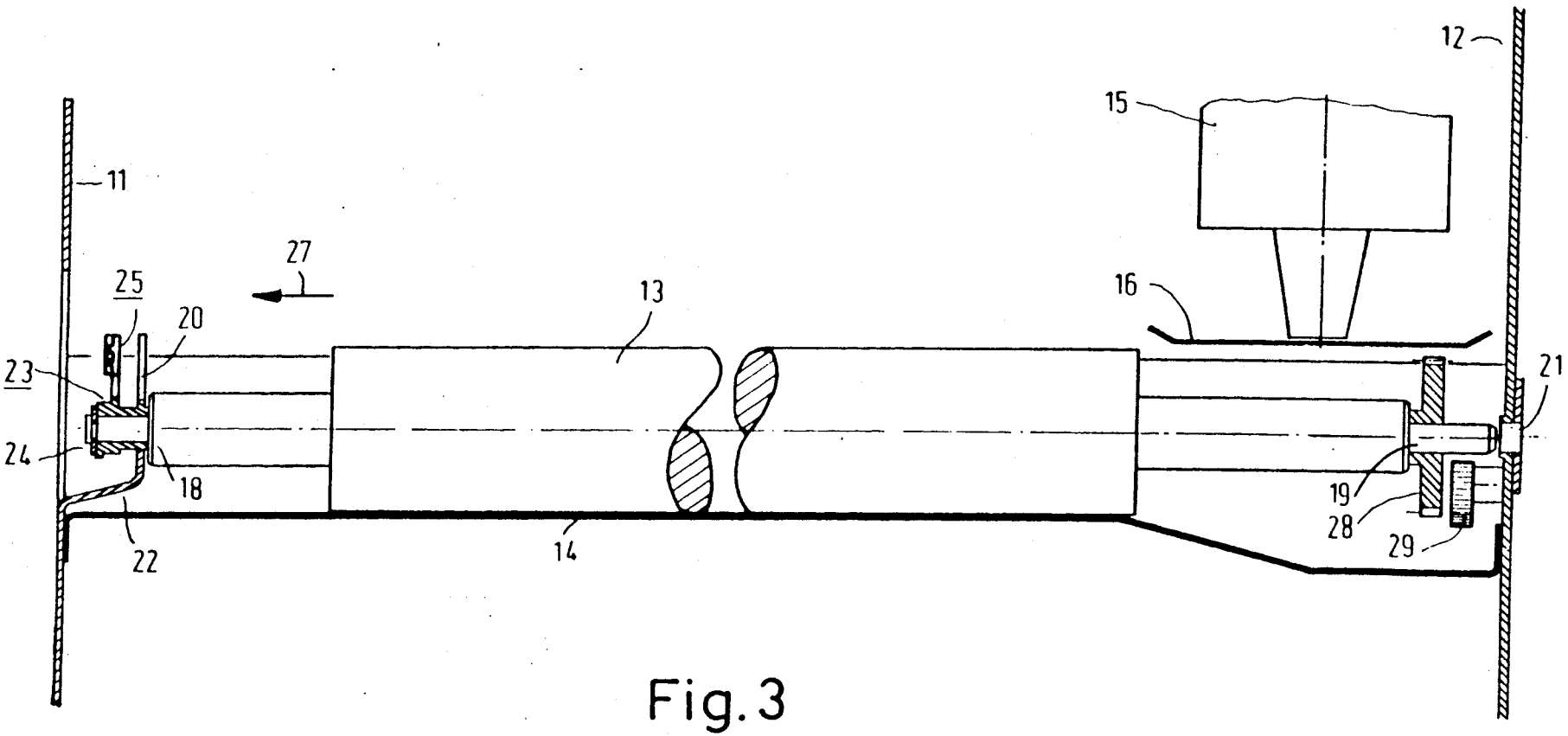
Figure 6:
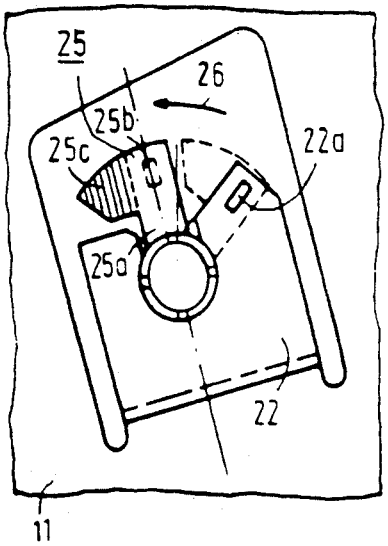
FIG. 6 is a sectional view A-B according to FIG. 5.
Figure 5:
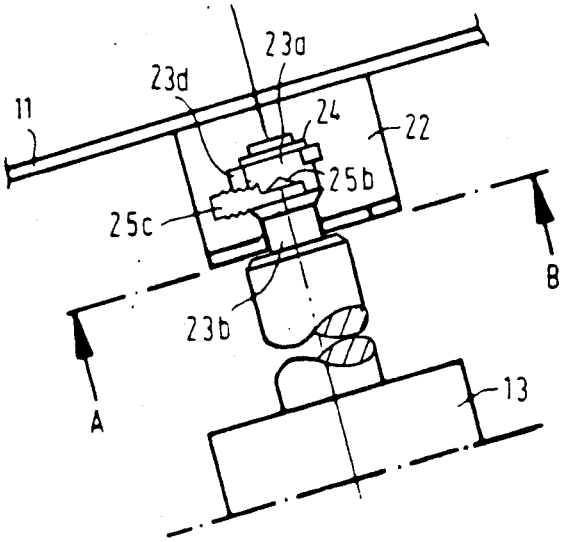
FIG. 5 shows a plan view of the left bearing position of the drum.

FIG. 2 shows the drum 13 with the printing head 15 and its paper guide 16, the drum being journalled in the walls 11, 22 and 12, respectively. The printing head 15 is moved by a drive unit (not shown) over the drum 13 in order to carry out printing commands. For exchange of the drum 13, the printing head 15 is first brought into the extreme righthand position shown. Subsequently, the lefthand bearing position shown. Subsequently, the lefthand bearing position is unlocked. The unlocking can be seen in FIGS. 5 and 6. The bearing bushing 23 has a flexible lever 25 having a narrow neck 25*a*, a detent snapping nose 25*b* and a projection 25*c*. The position shown in broken lines of the bearing bushing 23 (see FIG. 6) illustrates the fixed position. For unlocking, the flexible lever 25 is first laterally deflected, as a result of which the snapping nose 25*b* is lifted out of a snapping cradle recess 22*a* of the supporting wall 22. The snapping nose and the snapping lever may alternately be arranged in the supporting wall 22 or in the flexible lever 25. The flexible lever 25 is then rotated in the direction of the arrow 26 into the position shown in FIG. 6. In this position, the drum 13 can be moved in the longitudinal direction of the arrow 27, the narrow neck 25*a* of the flexible lever 25 being moved through the narrowed entrance 20*a* of the bearing recess 20. The position of the drum 13 after the termination of this movement is shown in FIG. 3. In the fixed position shown in FIG. 2, the bearing bushing 23 is located with the first section 23*a* in the bearing recess 20. In the position shown in FIG. 3, the bearing bushing 23 is located with a second narrowed section 23*b* in the bearing recess 20. The oblique transition region 23*c* serves to facilitate the mounting operation. In the position shown in FIG. 3, a gear wheel 28 is out of engagement with a driving gear wheel 29. Further, the journal 19 has disengaged the bearing opening 21.

Since the narrowed section 23*b* of the bearing bushing has a smaller diameter than the width of a first part 20*a* of the bearing opening 20, the drum 13 according to FIG. 4 can be lifted out upwards in the transverse direction with its lefthand end. Disassembling consequently takes place around the writing head 15 along the paper guide 16. The trough 14 of sheet metal arranged around the drum 13 has a guiding function for the drum and has in the righthand part a depression (guide part) 14*a* in order that projecting parts, for example the gear wheel 28, do not hinder the assembling or disassembling operation. During disassembling, the drum 13 falls downwards into the trough 14 after the journal 19 has left the bearing 21 and can then be transversely lifted on the lefthand side to remove it from the printer according to FIG. 4. The righthand edge 13*a* of the drum 13 or the gear wheel 28 then slides over the bottom contour of the trough 14 so that the drum 13 with the gear wheel 28 is guided around the printing head 15. The trough 14 moreover prevents possible damage of the electronic components 17 during assembling or disassembling.

The assembly of the drum 13 takes place in inverse order of disassembly. To this end, the drum 13 is introduced into the trough 14, the drum being exactly guided by the walls of the trough, so that upon longitudinal displacement to the right the journal 19 finds exactly and automatically the bearing opening 21.

Figure 7:
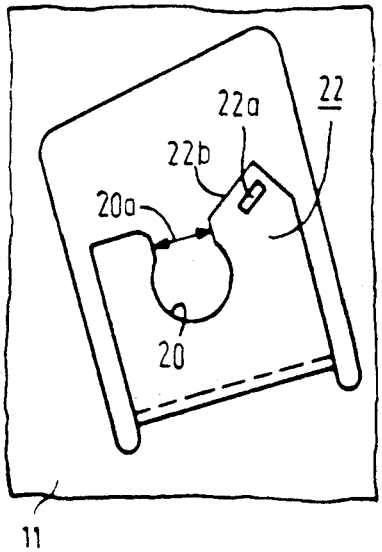
FIG. 7 is an elevation according to FIG. 6 without the drum.

FIG. 7 shows the elevation of the supporting wall 22 from the direction 27 without an introduced drum. The rotary movement of the bearing bush 23 may be limited by the projection 25*c*, which, after the rotation has been accomplished, engages a bevelled edge 22*b* of the supporting wall 22. The bevelled edge 22*b* serves to support the projection 25*c* of the flexible lever 25. The cradle 22*a* and the bevelled edge 22*b* are adapted to each other.

FIGS. 8*a* and 8*b* show the bearing bushing in two different elevations. Reference numeral 23*d* designates an outer flange. The outer flange 23*d* of the bearing bushing 23 extends over at least a part of the periphery of the bearing bushing 23. In the fixed position, the supporting wall 22 is located between the flange 23*d* and the flexible lever 25 or the neck 25*a*.

I claim:

1. A mechanism for releaseably securing a platen drum to a printing apparatus, said apparatus including first and second spaced walls, the first wall including an annularly enclosed bearing, said mechanism comprising:

a platen drum having a journal at one end for longitudinal reception by said bearing;

a support wall secured to one of and between the first and second walls, said support wall comprising a segment of a bearing having a transverse opening of a given width; and drum locking means secured to a drum end opposite the one end and cooperating with said support wall bearing for sequentially initially longitudinally and then transversely releaseably securing the drum opposite end to said support wall bearing.

2. The mechanism of claim 1 wherein said locking means includes a bushing secured to the drum end opposite the one end, said bushing mating with said wall bearing, said locking means including a lever secured to the bushing, said lever having first and second positions and being so dimensioned to longitudinally and transversely lock the drum to said support wall in the first position and longitudinally and transversely release the drum in the second position, said bushing being dimensioned to transversely pass through said transverse opening in the drum release condition.

3. The mechanism of claim 2 wherein said bushing has a first region diameter greater than the transverse width, said first region mating with said support wall bearing, a second region diameter between the first region and enclosed bearing dimensioned to permit the second region to pass through said transverse opening, said lever being positioned between the first and second regions.

4. The mechanism of claim 1 wherein the support wall is a bent portion of the second wall.

5. The mechanism of claim 2 wherein the support wall is a bent portion of the second wall.

6. The mechanism of claim 1 wherein the locking means comprises a resilient lever secured to the drum opposite one end and a projection secured to one of the lever, and second wall and a projection receiving recess in the other of said lever and second wall for selectively locking the drum to the second wall when the projection and recess are engaged.

7. The mechanism of claim 6 wherein said lever includes a projecting portion and said support wall includes a bevelled edge, said projecting portion and edge being dimensioned to abut in the secured position of said drum.

8. The mechanism of claim 3 wherein said bushing is annular and includes an outer flange distal said drum over at least a portion of the periphery of the bushing.

9. The mechanism of claim 2 wherein said bushing has a first diameter to which the lever is secured and a second diameter smaller than the first diameter, said second diameter being dimensioned to pass through said transverse opening, said first diameter being greater than the given width.

10. The mechanism of claim 7 wherein said bushing has a first diameter to which the lever is secured and a second diameter smaller than the first diameter, said second diameter being dimensioned to pass through said transverse opening, said first diameter being greater than the given width.

11. The mechanism of claim 1 further including drum guide means constructed to align to drum journal with the enclosed bearing when the drum is longitudinally displaced to engage that bearing.

12. The mechanism of claim 10 further including drum guide means constructed to align the drum journal with the enclosed bearing when the drum is longitudinally displaced to engage that bearing.

13. The mechanism of claim 11 wherein said guide means comprises a trough member postitioned adjacent to said enclosed bearing and dimensioned to receive the drum therein.

14. The mechanism of claim 13 wherein said trough member has an offset region adjacent to said enclosed bearing to permit pivoting of the drum prior to engagement and subsequent to disengagement of the journal with said enclosed bearing.

15. The mechanism of claim 2 wherein said lever has a neck portion dimensioned to longitudinally pass through said transverse opening of a given width when in said second position.

16. A device for detachably securing a platen drum of a printing apparatus to a spaced pair of sidewalls of the apparatus, the drum having a first bearing bushing at one end and a journal at the other end which mates with an annular enclosed second bushing secured to one sidewall, a flexible locking lever secured to the first bearing bushing for selectively securing the drum to the other sidewall, the combination therewith comprising a bearing secured to the other sidewall having a transverse opening for laterally and longitudinally receiving said first bearing bushing therethrough, said bearing being spaced from the other sidewall toward the enclosed bushing.

* * * * *